US006886959B2

(12) United States Patent
Record

(10) Patent No.: US 6,886,959 B2
(45) Date of Patent: May 3, 2005

(54) ILLUMINATION ASSEMBLY

(76) Inventor: Sharon Record, 177 Thompson St., Middleborough, MA (US) 02346

( * ) Notice: Subject to any disclaimer, the term of this patent is extended or adjusted under 35 U.S.C. 154(b) by 45 days.

(21) Appl. No.: 10/391,285

(22) Filed: Mar. 18, 2003

(65) Prior Publication Data

US 2004/0184265 A1 Sep. 23, 2004

(51) Int. Cl.[7] ..... F21V 35/00; F23D 3/16
(52) U.S. Cl. ..... 362/161; 362/447
(58) Field of Search ..... 362/161, 445, 362/157–159, 182, 160, 163, 162; 431/253, 289, 291, 287; 206/102; 131/185, 234, 239, 249, 251; 44/506–507, 510

(56) References Cited

U.S. PATENT DOCUMENTS 1,504,357 A * 8/1924 Lebwohl ..... 206/91
3,985,492 A 10/1976 Nunemaker
5,154,600 A * 10/1992 Sylvestre ..... 431/253
5,433,595 A 7/1995 Wentzell et al.
6,439,880 B1 * 8/2002 Ray ..... 431/288

FOREIGN PATENT DOCUMENTS

EP 407913 A * 1/1991 ..... F21V/35/00

* cited by examiner

*Primary Examiner*—Alan Cariaso
*Assistant Examiner*—Guiyoung Lee
(74) *Attorney, Agent, or Firm*—AKC Patents, LLC; Aliki K. Collins

(57) ABSTRACT

An illumination assembly includes a container adapted to contain a flammable light source, a flammable light source contained within the container, and a cover adapted to cover a top opening of the container. The cover includes a closable cavity adapted to safely store a lighting source capable for lighting the flammable light source. The container may be a jar, a lamp, or a lantern. The flammable light source may be a wax-based candle, a liquid or solid fuel lamp. The lighting source may be a match and a match-striking element or a self-ignitable lighter. In alternative embodiments the lighting source may be contained within a closable cavity formed within the base of the container or within a pouch attached to an outer surface of the container.

19 Claims, 5 Drawing Sheets

ILLUMINATION ASSEMBLY

FIELD OF THE INVENTION

The present invention relates to an illumination assembly, and more particularly to an illumination assembly that includes a flammable light source and a lighting source.

BACKGROUND OF THE INVENTION

Candles contained in jars are very popular decorative illumination articles. Molten wax is usually poured in a jar and one or more wicks are embedded in the wax to form a candle within the jar. The molten wax solidifies and takes the shape of the glass container. There is a large variation of candle colors, designs, fragrances and jar types. Typical jars used in jar candles include apothecary jars, jelly jars and mason type jars. The jars are usually made of glass and may have a removable cover covering the top opening of the jar. The cover is usually removed when the candle is lit.

Alternatives to jar candles are candle lanterns and lamps that include a candleholder supporting one or more candles and a container surrounding the candleholder and the candles. The container is usually made of glass or in some cases of metal, ceramic or other heat resistant material that has openings that let the candle light pass through. In some cases, instead of candles, liquid or solid fuel lamps are included in the lantern for providing light.

A common problem with the lighting of a candle, lantern, lamp or any other illumination assembly that uses a flammable light source is locating a lighting source. Typical lighting sources include matches that use a match-striking component for ignition, and self-ignitable lighters. Matches are usually kept separate from the candles and a user frequently searches for them in order to light the candle. This may cause a problem in cases of an emergency or an electric power failure, when there is not sufficient light to safely search and locate a lighting source.

Accordingly, there is a need for an illumination assembly that includes a flammable light source and provides an aesthetically pleasing and safe storage of a lighting source.

SUMMARY OF THE INVENTION

In general, in one aspect, the invention features an illumination assembly including a container adapted to contain a flammable light source, a flammable light source contained within the container, and a cover adapted to cover a top opening of the container. The cover includes a closable cavity adapted to safely store a lighting source capable for lighting the flammable light source.

Implementations of this aspect of the invention may include one or more of the following features. The flammable light source may comprise a wax-based candle having at least one wick. The container may be a jar having a top opening, an outer surface, and a bottom surface. The jar may be an apothecary jar, a jelly jar, a mason jar, or any other cup-like container. The wax-based candle may fill the jar and conform to the shape of the jar. The candles may be candles conforming to the shape of the container, taper candles, pillar candles, scented candles, unscented candles, single-color candles, multi-colored candles, one-component candles, multi-component candles, or gel-type candles. The flammable light source may be a liquid fuel lamp or a solid fuel lamp. The lighting source may include at least one match and a match-striking component. The match-striking component may be affixed upon an outer surface of the container or upon the cover. The match-striking component may be affixed upon the outer surface of the container or the cover with an adhesive. The match-striking component may be painted upon the outer surface. The lighting source may be a self-ignitable lighter. The cover may be dome-shaped having a cavity for storing the lighting source and having a bottom opening adapted to be closed with a lid cover. The container may be made of glass, metal, ceramic or other heat resistant materials. The illumination assembly may further include a first label affixed on an outer surface of the container. The first label may display a name of a candle company. The illumination assembly may further include a second label affixed on a bottom surface of the container. The second label may display a safety message. The illumination assembly may include one or more labels affixed on a surface of the container.

In general, in another aspect, the invention features an illumination assembly including a candleholder having a base and being adapted to support at least one candle, a container surrounding the candleholder having a base and being adapted to support the at least one candle, and a closable cavity formed within the base and adapted to store a lighting source capable for lighting the candle.

In general, in another aspect, the invention features an illumination assembly including a jar, a flammable light source contained within the jar, and a cover adapted to cover a top opening of the jar. The cover comprises a closable cavity adapted to store a lighting source capable for lighting the flammable light source.

In general, in another aspect, the invention features an illumination assembly including a container having a top opening and being adapted to contain a flammable light source, a flammable light source contained within the container, and a closable pouch adapted to be affixed to an outer surface of the container and to store a lighting source capable for lighting the flammable light source.

Among the advantages of this invention may be one or more of the following. The invention provides a decorative illumination device that includes a flammable light source and a lighting source capable of lighting the flammable light source. The lighting source is stored in the same container that contains the flammable light source in a safe, secure and aesthetically pleasing way. The lighting source is always within reach of the flammable light source, which can be advantageous in cases of emergency or electrical power failure when there is not sufficient light.

The details of one or more embodiments of the invention are set forth in the accompanying drawings and description below. Other features, objects and advantages of the invention will be apparent from the following description of the preferred embodiments, the drawings and from the claims.

BRIEF DESCRIPTION OF THE DRAWINGS

Referring to the figures, wherein like numerals represent like parts throughout the several views.

DETAILED DESCRIPTION OF THE INVENTION

This invention refers to decorative illumination assemblies that include a flammable light source and a lighting source. Flammable light sources include candles, oil lamps and solid fuel lamps. Lighting sources include matches and self-ignitable lighters.

Figure 1:
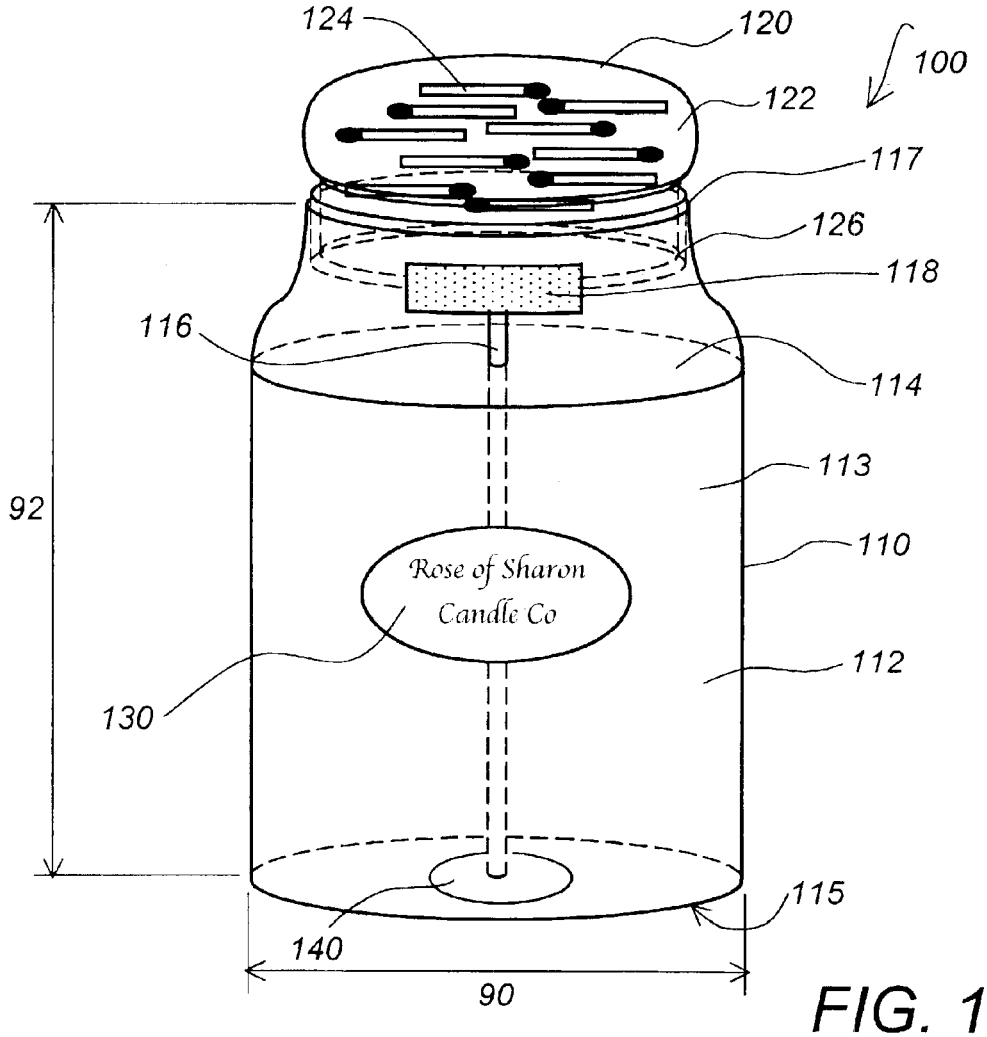
FIG. 1 is a perspective view of a jar candle assembly according to this invention.

Referring to FIG. 1, an illumination assembly 100 includes a glass apothecary jar 110 having a cover 120. The apothecary jar 110 has an outer surface including a front surface 113, a bottom surface 115 and a top opening 117. Within the apothecary jar 110 there is a wax candle 112 conforming to the shape of the jar and having a top surface 114 and a wick 116 embedded within the wax 112. The outer surface of the apothecary jar 110 includes a match striking strip 118, a label 130 depicting the name of the product and/or the candle company and a label 140 displaying a safety warning message. In this example the striking strip 118 and label 130 are affixed on the front surface 113 of the apothecary jar, whereas the warning label 140 is affixed on the bottom surface 115 of the apothecary jar. The top opening 117 of the apothecary jar 110 is closed with the cover 120.

Figure 2:
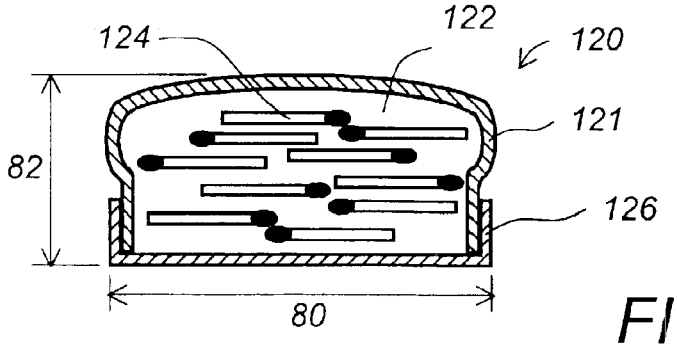
FIG. 2 is a cross-sectional view of the cover of the jar candle assembly of FIG. 1.

Referring to FIG. 1 and FIG. 2, cover 120 includes a dome 121 and a lid 126 covering a bottom opening of the dome. Within the dome there are matches 124 contained. Lid 126 covers the bottom opening of the cavity 122 that is formed by the dome 121 and provides a tight fitting closure for the apothecary jar top opening 117. In order to light the wax candle 112, a user removes the cover 120 from the jar 110, then removes the lid 126 from the cover 120, and takes out a match 124. The user then strikes the match against the striking strip 118 and lights the match. The user then uses the lit match 124 to light the wax candle 112. Next, the user closes the cover 120 with the lid 126 and sets it aside while the candle 112 is lit. Finally, when the candle 112 is extinguished the user places the cover 120 back on the top of the apothecary jar 110.

In one example the apothecary jar 110 is made of clear glass and has a diameter 90 of 10 inches and a height 92 of 10 inches. The dome cover 120 is also made of glass and has a diameter 80 of 8 inches and a height 82 of 5 inches. The lid 126 is made of a plastic material and is adapted to fit tight over the bottom opening of the dome cover 120. Lid 126 also provides a tight closure for the top opening 117 of the apothecary jar 110. The striking strip 118 has a length of 2 inches, a width of one quarter of an inch, and is affixed on the front surface 113 of the apothecary jar 110 with an adhesive.

Figure 3:
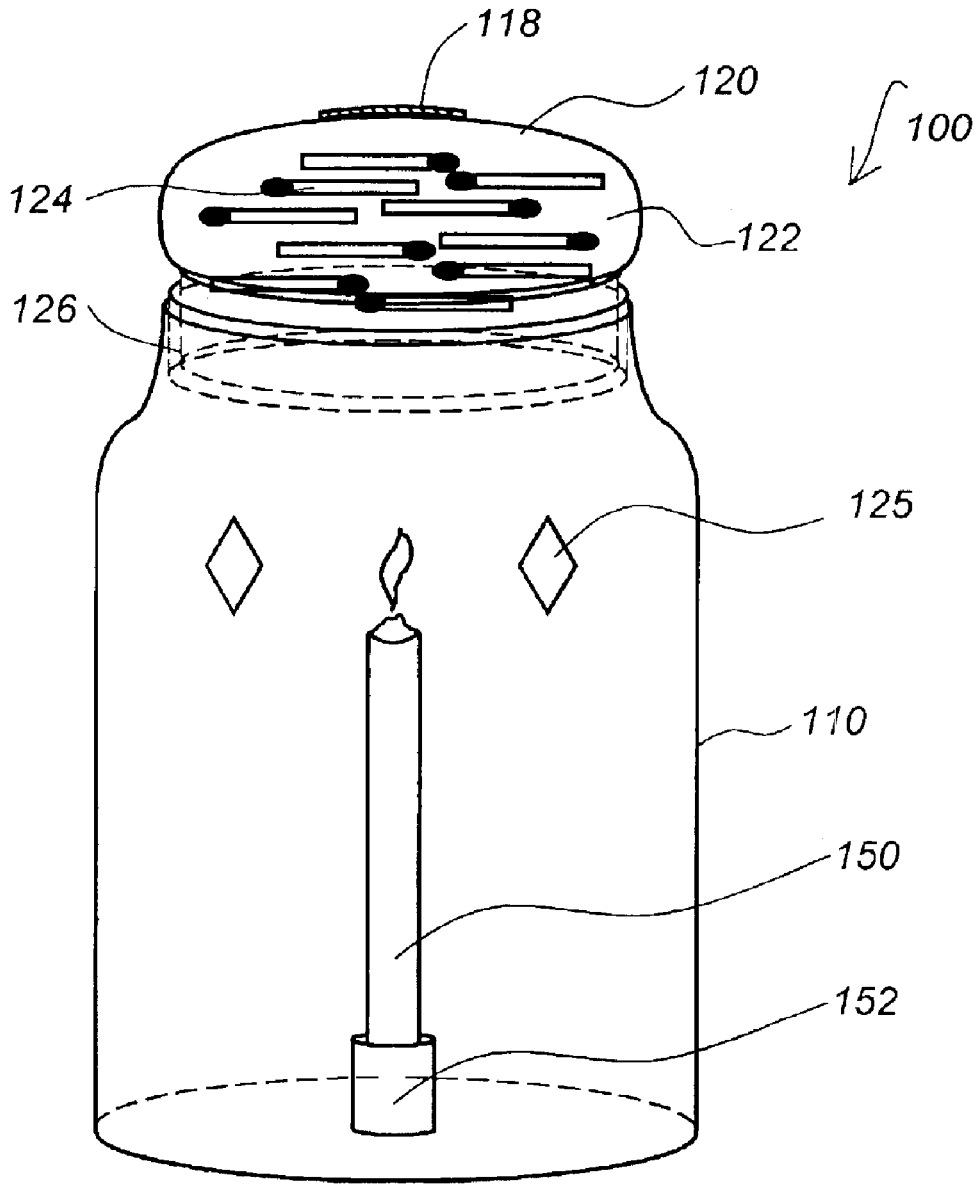
FIG. 3 is a perspective view of another embodiment of a jar candle assembly according to this invention.

In the illumination assembly 100 of FIG. 3, the apothecary jar 110 has a built-in candleholder 152 at the bottom of the jar. A taper candle 150 is placed in the candleholder 152. A user extracts a match from the cover 120 strikes it against the striking material 118 and lights the candle 152. The striking material 118 is circular shaped and is affixed at the top of the dome cover 120.

Figure 4:
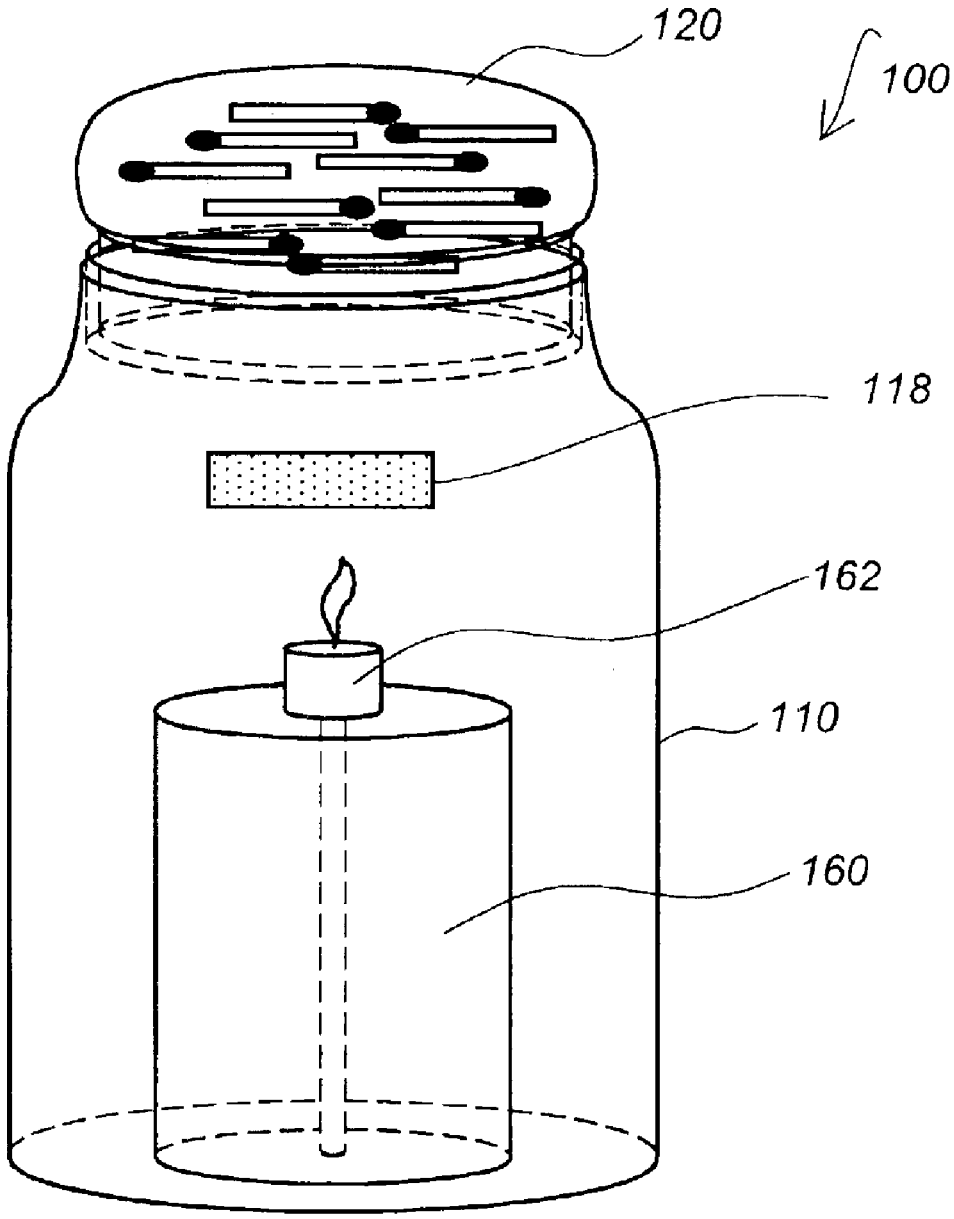
FIG. 4 is a perspective view of a jar oil lamp assembly according to this invention.

In the embodiment of FIG. 4, the illumination assembly 100 includes a lamp 160 in the apothecary jar 110, instead of a wax candle 112. The lamp 160 has a wick 162 and uses oil or solid fuel.

Figure 5:
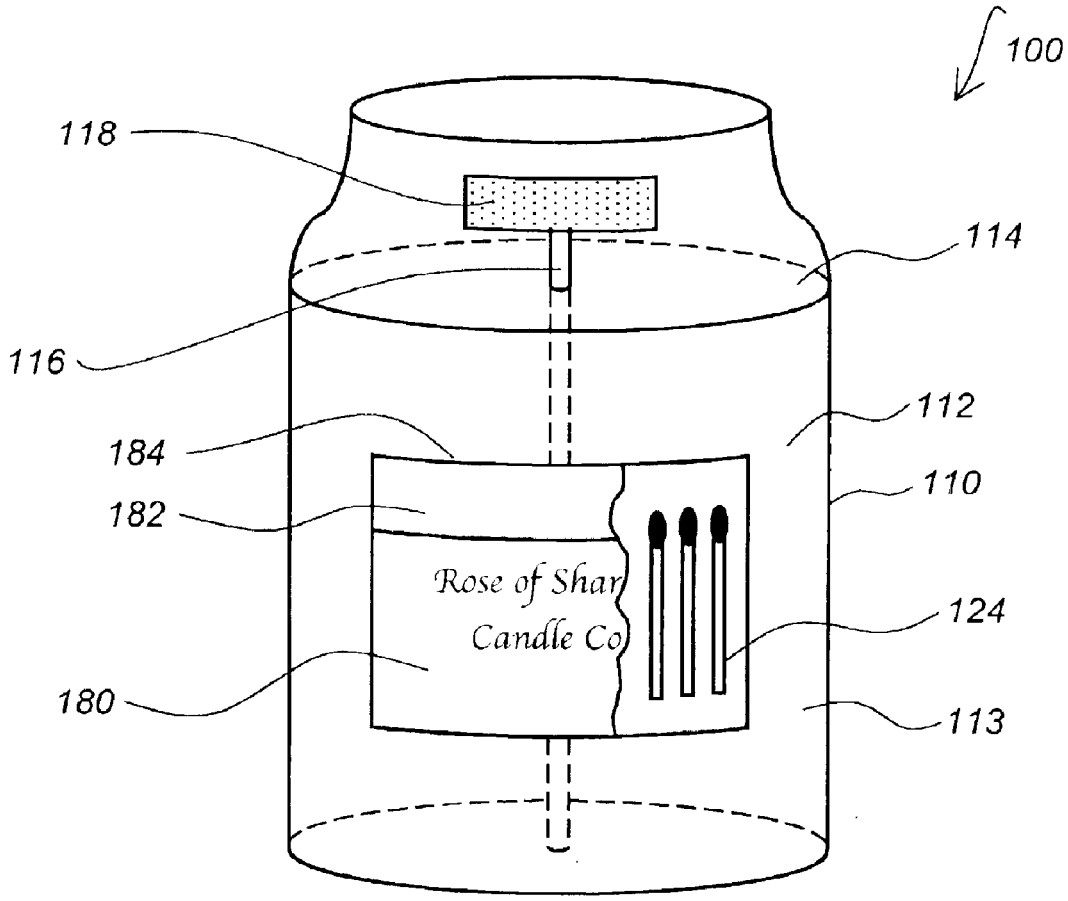
FIG. 5 is a perspective view of another embodiment of a jar candle assembly according to this invention.

Referring to FIG. 5, in another embodiment of the illumination assembly 100, the matches 124 are contained within a pouch 180 that is affixed on the front surface 113 of the apothecary jar 110. The pouch 180 is attached on the jar surface 113 with an adhesive 184. The pouch 180 has a top flap cover 182 that closes using hook and loop type closures. A user opens the flap cover 182, removes a match 124, strikes the match against the striking strip 118 thereby lighting the match and uses the lit match to light the wick 118 of the candle 112.

Figure 6:
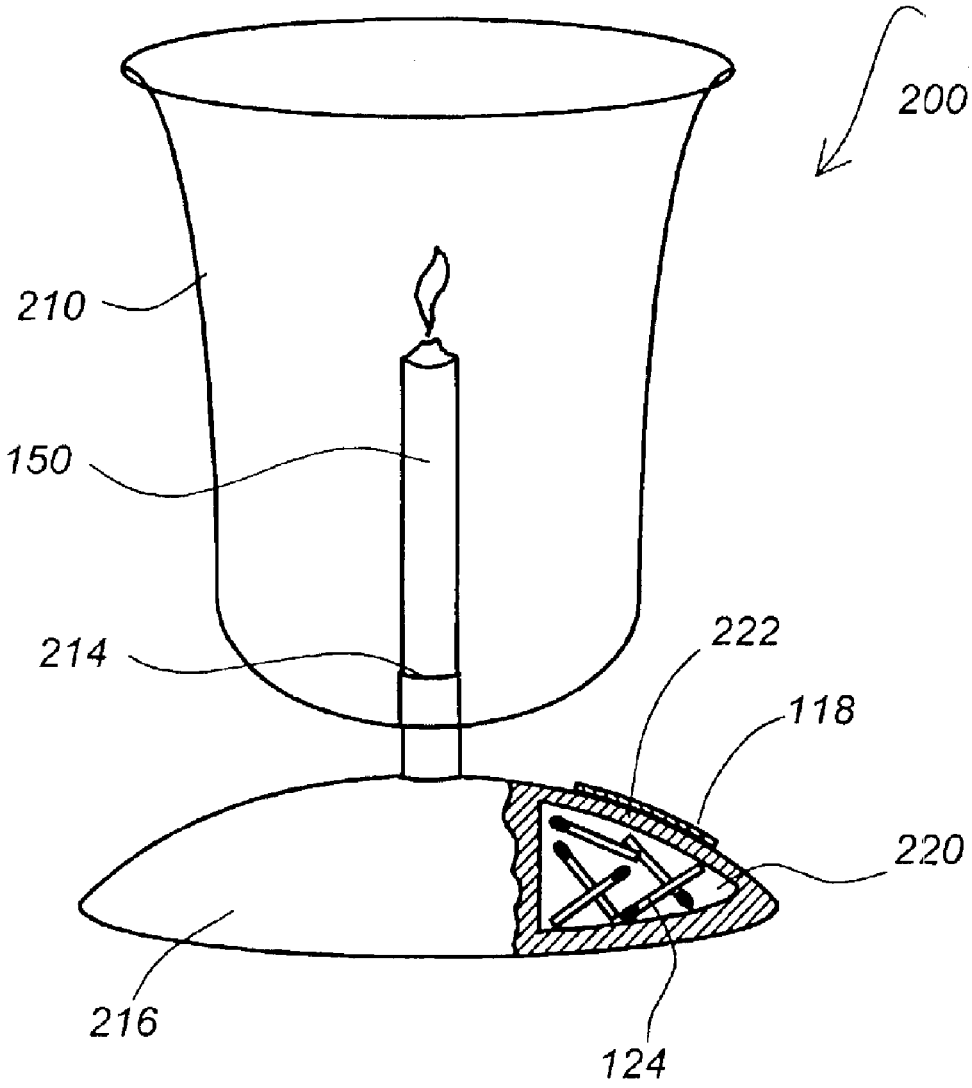
FIG. 6 is a perspective view of a candle lamp assembly according to this invention.

In the embodiment of the illumination assembly of FIG. 6, a hurricane type lamp 200 includes an urn-shaped glass 210 supported by a base 216. The base 216 extends into the glass 210 and forms a candleholder 214 capable of supporting a taper candle 150. The base 216 further includes a cavity 220 formed within the base. Cavity 220 is accessible from the outside by opening a cover 222. Within the cavity there are matches 124 contained. A piece of striking material 118 is attached on the cover 222 via an adhesive.

Other embodiments are within the scope of the following claims. For example, the apothecary jar may be cylindrical, square, hexagonal or any other polygonal shape. The jar may be made of glass, metal, ceramic, tin, or any other heat resistant material. The top outer surface of the jar may have openings 125 that allow the light to pass through. The jar may also be a mason type jar with a removable glass lid. The wax candle 112 may be scented or not scented, colored or transparent. The colored candles 112 may be single or multi-colored. The candle 112 may also have designs and include one or more components. The candle 112 may be a gel-type candle. The cover 120 may be dome shaped, cylindrical or any other shape that allows the formation of an inner cavity for housing the matches. The matches may have a length varying from 1 to 2 inches. The matches may be colored. The matches may also be safety matches, fast lighting matches or waterproof matches. Depending upon the size of the dome cavity 122, the size of the pouch 180, or the size of the base cavity 220, the number of matches may vary from a few to 100 or more. The striking material 118 may have a strip, square or circular form. In some cases the striking material may be painted on the outer surface of the jar. Instead of matches, a self-ignitable lighter may be contained in the dome cavity 122 or the pouch 180 of the jar candle 100 or the base cavity 220 of the hurricane lamp 200

Several embodiments of the present invention have been described. Nevertheless, it will be understood that various modifications may be made without departing from the spirit and scope of the invention. Accordingly, other embodiments are within the scope of the following claims.

What is claimed is:

1. An illumination assembly comprising:

a container adapted to contain a flammable light source, said container having a top opening;

a flammable light source contained within said container;

a cover adapted to cover said top opening of said container, said cover comprising a reclosable cavity adapted to store safely a lighting source capable for lighting said flammable light source; and said cover comprising a lid and a dome, said lid covering a bottom opening of said dome;

wherein said lighting source comprises at least one match stored in said reclosable cavity and a match-striking component affixed upon an outer surface of said container.

2. The illumination assembly of claim 1 wherein said flammable light source comprises a wax-based candle having at least one wick.

3. The illumination assembly of claim 2 wherein said container comprises a jar having said top opening, an outer surface, and a bottom surface.

4. The illumination assembly of claim 3 wherein said jar is selected from a group consisting of apothecary jars, jelly jars, mason jars, and other cup-like containers.

5. The illumination assembly of claim 3 wherein said wax-based candle fills and conforms to a shape of said jar.

6. The illumination assembly of claim 1 wherein said flammable light source is selected from a group consisting of candles conforming to a shape of said container, taper candles, pillar candles, scented candles, unscented candles, single color candles, multi-colored candles, one component candles, multi-component candles, and gel candles.

7. The illumination assembly of claim 1 wherein said flammable light source comprises a liquid fuel lamp.

8. The illumination assembly of claim 1 wherein said flammable light source comprises a solid fuel lamp.

9. The illumination assembly of claim 1 wherein said match-striking component is affixed upon said cover.

10. The illumination assembly of claim 1 wherein said match striking component is affixed upon said outer surface with an adhesive.

11. The illumination assembly of claim 1 wherein said match striking component is painted upon said outer surface.

12. An illumination assembly comprising:

a container adapted to contain a flammable light source, said container having a top opening;

a flammable light source contained within said container;

a cover adapted to cover said top opening of said container, said cover comprising a reclosable cavity adapted to store safely a lighting source capable for lighting said flammable light source; and said cover comprising a lid and a dome, said lid covering a bottom opening of said dome;

wherein said lighting source comprises a self-ignitable lighter.

13. The illumination assembly of claim 1 wherein said cover comprises a dome having a bottom opening adapted to be closed with a lid cover, said dome forming a cavity for storing said lighting source.

14. The illumination assembly of claim 1 wherein said container is made of a material selected from a group consisting of glass, metal, ceramic and other heat resistant materials.

15. The illumination assembly of claim 1 further comprising a first label affixed on an outer surface of said container, said first label comprising a name of a candle company.

16. The illumination assembly of claim 1 further comprising a second label affixed on a bottom surface of said container, said second label comprising a safety message.

17. The illumination assembly of claim 1 further comprising one or more labels affixed on a surface of said container.

18. An illumination assembly comprising:

a candleholder having a base and adapted to support at least one candle source;

a container surrounding said candleholder;

a reclosable cavity formed within said base and adapted to store a lighting source capable for lighting said candle source and said reclosable cavity is accessible from the outside by opening a cover;

wherein said lighting source comprises at least one match stored in said reclosable cavity and a match-striking component affixed upon an outer surface of said base.

19. An illumination assembly comprising:

a container adapted to contain a flammable light source, said container having a top opening;

a flammable light source contained within said container; and a closable pouch adapted to be affixed to an outer surface of said container and to safely store a lighting source capable for lighting said flammable light source, wherein said pouch including a top flap cover that closes using hook and loop type closures.

* * * * *